US007685942B1

(12) United States Patent
Powers, Jr.

(10) Patent No.: US 7,685,942 B1
(45) Date of Patent: Mar. 30, 2010

(54) FRANGIBLE POWDERED IRON PROJECTILES

(76) Inventor: Daniel L. Powers, Jr., 11802 Cliffwood Ct., Riverview, FL (US) 33569

( * ) Notice: Subject to any disclaimer, the term of this patent is extended or adjusted under 35 U.S.C. 154(b) by 0 days.

(21) Appl. No.: 12/400,857

(22) Filed: Mar. 10, 2009

Related U.S. Application Data

(62) Division of application No. 11/285,010, filed on Nov. 23, 2005, now Pat. No. 7,555,987.

(60) Provisional application No. 60/630,078, filed on Nov. 23, 2004.

(51) Int. Cl.
*F42B 12/74* (2006.01)

(52) U.S. Cl. ..... 102/506; 102/502; 102/517

(58) Field of Classification Search ..... 102/502, 102/506, 517
See application file for complete search history.

(56) References Cited

U.S. PATENT DOCUMENTS

| | | | | |
|---|---|---|---|---|
| 5,616,642 | A | 4/1997 | West et al. | |
| 5,814,759 | A | 9/1998 | Mravic et al. | |
| 6,090,178 | A | 7/2000 | Benini | |
| 6,182,574 | B1 * | 2/2001 | Giannoni | 102/516 |
| 6,263,798 | B1 | 7/2001 | Benini | |
| 6,640,724 | B1 * | 11/2003 | Robinson et al. | 102/517 |
| 6,691,623 | B1 * | 2/2004 | Stone | 102/506 |

FOREIGN PATENT DOCUMENTS

| | | | |
|---|---|---|---|
| EP | 0626 557 | A1 * | 11/1994 |
| EP | 0626557 | | 11/1994 |

* cited by examiner

*Primary Examiner*—Stephen M Johnson
(74) *Attorney, Agent, or Firm*—Connolly Bove Lodge & Hutz LLP

(57) ABSTRACT

Frangible projectiles for firearms and processes for making such projectiles are disclosed. The projectiles include a sintered, compacted mixture of powdered iron particles with other particles, including powdered copper particles and optionally powdered tin particles. The disclosed projectiles produce a similar feel and mimic the ballistic properties of lead projectiles of similar size and caliber, yet readily break-up upon impact with a hard surface in order to minimize ricochet or splatter. The disclosed projectiles and processes for making the projectiles meet the need for inexpensive, lead-free frangible projectiles.

6 Claims, No Drawings

FRANGIBLE POWDERED IRON PROJECTILES

CROSS-REFERENCE TO RELATED APPLICATIONS

This application is a divisional of U.S. application Ser. No. 11/285,010, filed Nov. 23, 2005, now U.S. Pat. No. 7,555,987, which claimed the benefit of U.S. Provisional Appl. No. 60/630,078, filed Nov. 23, 2004, entitled FRANGIBLE POWDERED IRON PROJECTILES.

BACKGROUND

The disclosure relates to frangible projectiles including a sintered, compacted, iron-based mixture of particles and, more specifically, to frangible bullets for use in target and training applications.

There is a need for training ammunition that can reduce or eliminate the risk of ricochet. Frangible ammunition, which breaks into small pieces upon impact, has been used in the past to meet these needs. A frangible projectile disintegrates upon impact with no appreciable back splash or ricochet which might injure the shooter, other persons nearby or equipment. Prior projectiles have been made substantially of lead. The use of lead produces undesirable health risks from airborne and sedentary lead particles. Lead particles present a health risk to shooters and others nearby, and also create an environmental problem where the lead particles fall to the ground upon impact of the projectile.

Two prior solutions to the need for frangible, lead-free projectiles have been (1) the use of a compacted, sintered admixture of metal particles comprising copper powder as the base metal, and (2) the use of a compacted, unsintered iron powder, as noted in U.S. Pat. Nos. 6,263,798 and 6,691,623.

SUMMARY

The projectiles disclosed herein satisfy the need for lead-free frangible projectiles without the expense of high cost materials and processing. A "frangible" projectile, as discussed herein, is defined as a projectile designed to readily break-up upon impact with a hard surface in order to minimize ricochet or splatter.

The disclosed projectiles produce a similar "feel" and mimic the ballistic properties of lead projectiles of similar caliber and size. The projectiles of this invention are sintered. This deviates from current iron powder metal technology where the projectiles are generally unsintered. Sintering increases the strength, hardness, structural integrity, and other mechanical properties.

Specifically, the disclosure provides frangible projectiles comprising sintered iron powder particles as the base metal, optionally including copper and/or tin particles. The powders are cold compacted to form the projectile, and then sintered. In an exemplary embodiment, the projectile has a jacket of metal or polymer, with copper being a possible jacket material.

DETAILED DESCRIPTION

The disclosed projectiles of the present invention will be more fully understood by reference to the following description. Both the projectiles and a process for the making of the projectiles will be described. Variations and modifications of both the projectiles and the process can be substituted without departing from the principles of the invention, as will be evident to those skilled in the art.

The projectiles are produced from a cold compacted iron based powder. "Cold compaction" is used in its customary meaning, that is, that the compaction is carried out at substantially ambient conditions, without applied heat.

Ancorsteel 1000 B, which is commercially available from Hoeganaes Corp., is one product that, due to its particle size distribution, is well suited for use as iron powder in the projectiles. However, other iron based powders with similar particle size distributions may also be used. Ancorsteel 1000 B and other similar products will provide the advantage of integrity of the projectile before and during firing and frangibility upon impact with a target media.

Once the powder is compacted into projectile cores, the cores are sintered at a temperature between 850° F.-1550° F. (454° C.-788° C.). The projectiles may be provided with a jacket surrounding the core. The jacket material can be selected from materials customarily used in the art, for example, metal or polymeric material. Metals which can be used include aluminum, copper, brass and zinc, with copper being a particularly suitable choice. Polymeric materials which can be used include polyethylene and polycarbonate, with a low density polyethylene material being particularly suitable.

The projectiles can have a variety of configurations, including shot and bullets, but are preferably formed into bullets for use with firearms. The bullets can have noses of various profiles, including round nose, flat point, or hollow point. Either the bullet or the jacket, if so provided, can include a driving band which increases the ballistic accuracy and reduces bullet dispersion.

The projectiles can be manufactured by a process wherein the powdered iron mixture of the desired particle sizes is admixed to provide a mixture with the desired particle size distribution. The powdered iron can also preferably be mixed with a lubricant. This lubricant aids in removing the projectiles from the mold after compaction is complete. If a lubricant is to be added, it can be added to the powdered iron admixture. Zinc stearate and lithium stearate are suitable lubricants. Other lubricants that are compatible with iron particles can be used. Up to about 1.0% by weight of zinc stearate can be beneficially added to the powdered iron prior to compaction. About 0.5% has been found to be particularly satisfactory.

The admixture is then placed in a die which is designed to provide the desired shape of the projectile. A wide variety of projectiles can be made, including shot and bullets. The invention is particularly beneficial in bullet manufacture, and especially those having a generally elongated configuration in which a leading end has a smaller circumference than a trailing end.

The admixture of iron based powder is cold compacted at a pressure of about from 50,000 to 120,000 psi, with a pressure of about 100,000 psi being particularly preferred. Compacting at a pressure of about 100,000 psi provides the best combination of projectile integrity before and during firing and frangibility upon impact with a target. The compaction step can be performed on any mechanical press capable of providing at least about 50,000 psi pressure for a dwell time which can be infinitesimally small. Presently available machinery operates with dwell times of about from 0.05 to 1.5 seconds. A conventional rotary dial press is well suited for performing compaction.

After compaction, the resulting projectile core is sintered at a temperature between 850° F.-1550° F. (454° C.-788° C.). After the projectile core is sintered, a jacket can be formed around the projectile, if so desired. Such a jacket is preferred for a number of reasons. The jacket isolates the powdered iron based material of the projectile from the gun barrel, preventing accelerated erosion of the rifling of the gun barrel which might result from direct contact between the interior surface of the barrel and the powdered metal of the projectile. The jacket also helps provide additional integrity of the projectile before and during firing, as well as improving the ballistics and accuracy of the projectile upon firing.

In the case of metal jackets, the jacket can be applied by any number of conventional processes, including acid or cyanide electroplating, mechanical swaging, spray coating, and chemical adhesion. Electroplating is a particularly suitable method for applying the jacket.

A variety of electroplating techniques can be used to apply the jacket, as will be evident to those in the plating art. In general, the projectiles are first cleaned, generally with an acid wash, and then sealed before the final plating. The sealing can be accomplished by impregnating the projectile core with a silicone solution (such as Imprex 95-1000A or Chemence Anaseal HC90), or by dipping the projectile in a solution of metal, such as copper, nickel or zinc, prior to the final plating. When sealing the surface with metal, copper is preferred.

In a preferred method of plating, a vacuum impregnation is performed after the acid wash. This impregnation involves infusion of the formed projectile cores in a silicone based material in a large batch type operation. The impregnation step reduces the porosity of the projectile cores by filling voids at or near the surface of the cores. These voids can contain impurities which might cause corrosion and plate fouling. The impregnation step also provides a barrier to prevent collection of plate bath chemicals in the recesses. Such collected chemicals could leach through the plating, discoloring and changing the dimensions of the projectile.

After sealing the surface of the projectile cores, the projectile cores are plated with jacketing material. If the jacketing material is copper or other metal, a desired thickness of the copper or other plating metal is deposited on the projectile. For copper jackets, acid copper plating is preferably used, which is faster and more environmentally friendly than alternative techniques, such as cyanide copper plating. After jacketing, the projectile can be sized using customary techniques and fabricated into a cartridge.

In addition to the protective benefits obtained by adding a jacket to the sintered powdered iron based projectile cores, the additional mass of the jacket aids in the functionality and reliability of the projectiles when used with semi-automatic and fully automatic firearms. Such firearms require that a minimal impulse be delivered to the gun slide for operation, and the mass added by a jacket (approximately 5-10% increase) provides enough mass for the use of the projectiles with these firearms.

The novel projectiles are further illustrated by the following specific example, in which parts and percentages are by volume, unless otherwise indicated.

EXAMPLE

Iron powders are blended with other metals like copper and/or tin. The blend is pressed to form 9 mm small arms bullet cores at ambient temperature and a pressure of 100,000 psi (7030 kg/cm$^2$) and sintered at 850° F.-1450° F. (454° C.-788° C.). A copper jacket is applied to the bullet cores by washing with acid, impregnating with silicone solution (either Imprex 95-1000A or Chemence Anaseal HC90), or dipping in a nickel solution, and then electroplating the cores with copper to provide an outer jacket having a thickness of 5 mils (0.13 mm).

The resulting bullets are fabricated into cartridges with appropriate explosive charges, and tested for frangibility on firing. The bullets fracture on impact to fine iron powder of 1-2 grains or less. The copper jacketing also fractures, but with pieces no larger than 5.0 grains.

What is claimed is:

1. A lead-free, frangible, sintered firearm projectile, comprising:

a projectile core formed from an admixture of cold compacted metal powders, consisting essentially of:

powdered iron particles/are powdered copper particles; and powdered tin particles;

wherein the powdered iron particles comprise at least 70% by volume of metal particles in the admixture, the admixture is lead-free, and wherein the projectile core is sintered at a temperature in the range of 850° F. to 1450° F. (454° to 788° C.).

2. The firearm projectile of claim 1, wherein the powdered iron particles, powdered copper particles and powdered tin particles in the admixture are present in volumetric percentages of 70% powdered iron particles, volume, 20% powdered copper particles, and 10% powdered tin particles.

3. The firearm projectile of claim 1, further comprising a lubricant when admixing the metal powders.

4. The firearm projectile of claim 1, further comprising a silicone solution impregnated into or onto the projectile core as a seal for the projectile core.

5. The firearm projectile of claim 1, further comprising a metal solution coated onto the projectile core as a seal for the projectile core.

6. The firearm projectile of claim 1, further comprising a jacket plated over the projectile core.

* * * * *

UNITED STATES PATENT AND TRADEMARK OFFICE

CERTIFICATE OF CORRECTION

PATENT NO. : 7,685,942 B1
APPLICATION NO. : 12/400857
DATED : March 30, 2010
INVENTOR(S) : Daniel L. Powers, Jr.

It is certified that error appears in the above-identified patent and that said Letters Patent is hereby corrected as shown below:

Col. 4, line 28, in the second subparagraph of Claim 1, it should read -- powdered iron particles; -- not "powdered iron particles/are."

Signed and Sealed this

First Day of June, 2010

David J. Kappos

David J. Kappos
*Director of the United States Patent and Trademark Office*